United States Patent [19]

Deutsch

[11] 4,354,412

[45] Oct. 19, 1982

[54] ADAPTIVE METRONOME FOR AN AUTOMATIC RHYTHM GENERATOR

[75] Inventor: Ralph Deutsch, Sherman Oaks, Calif.

[73] Assignee: Kawai Musical Instrument Mfg. Co., Ltd., Hamamatsu, Japan

[21] Appl. No.: 264,763

[22] Filed: May 18, 1981

[51] Int. Cl.[3] ..... G10H 1/42; G10H 7/00

[52] U.S. Cl. ..... 84/1.01; 84/1.03; 84/1.24; 328/14; 364/701

[58] Field of Search ..... 84/1.01, 1.03, 1.24–1.27, 84/484, DIG. 11; 328/14; 364/701

[56] References Cited

U.S. PATENT DOCUMENTS 3,976,945 8/1976 Cox ..... 328/14

*Primary Examiner*—Stanley J. Witkowski

*Attorney, Agent, or Firm*—Ralph Deutsch

[57] ABSTRACT

A sequence of timing signals is generated having a time spacing corresponding to the average spacing between successive actuations of a control switch. The system automatically starts a new calculation if the control switch is actuated at least two times with a time spacing less than some prespecified threshold time. The data input process is self-terminated when a time interval equal to the threshold time expires after an actuation of the control switch. The generated sequence of timing signals can be used as the metronome clock for an automatic rhythm generator.

13 Claims, 2 Drawing Figures

ADAPTIVE METRONOME FOR AN AUTOMATIC RHYTHM GENERATOR

BACKGROUND OF THE INVENTION

1. Field of the Invention

This invention relates to an electronic musical instrument and in particular is concerned with a metronome clock means for an automatic rhythm generator.

2. Description of the Prior Art

Automatic rhythm generators are used to create a rhythmic background pattern of sounds which are used in combination with music played by a performer on an musical instrument. Such generators are commonly incorporated as subsystems in an electronic keyboard instrument such as an organ. Automatic rhythm generators use a controllable variable speed clock to generate timing signals which control the generator logic system. This clock is called the metronome clock because it establishes the timing of the beats within a musical measure. Most automatic rhythm generators use a lamp which is illuminated at the metronome clock rate. By visually observing the blinking rate of this lamp, the musician varies a clock rate control until he establishes a desired metronome clock rate. A rhythm generator having these features is described in U.S. Pat. No. 3,763,305.

While the procedure of visually setting the metronome clock rate is easy to implement, one finds that this is not a "natural" technique for a musician. The musician does not hear any sounds from the metronome clock and the player is usually unaccustomed by training or intuition to associate a blinking lamp rate with a desired metronome rate for a selected rhythm pattern. It is not at all unusual, even in a concert environment, to find that a musician ignores the lamp and turns on the rhythm sounds so that he can hear the rhythmic pattern as he adjusts the metronome clock's speed. By training, or perhaps by some inherent instinct, musicians seem to have a tactile sense of communicating and remembering a rhythm rate. This tactile sense of communicating a metronome beat is very apparent when one notices many members of an orchestra "beating time" with their feet. They do this in spite of the fact that the conductor is furnishing a visual metronome rate via the gyrations of his baton.

SUMMARY OF THE INVENTION

The present invention is directed to apparatus for producing automatic rhythm patterns by employing a metronome clock whose rate is adaptive to a sequence of switch closures.

The metronome clock rate is controlled from time data furnished by the player in the form of a sequence of switch closures. The average interval between the switch closures is determined and stored as a frequency control number. The frequency control number is used in a non-integer frequency divider which serves the function of a metronome clock for the rhythm generator. A time threshold subsystem is provided so that successive switch closings occuring for a time interval greater than a prespecified time are ignored. Two or more switch closures are sufficient to provide the data for controlling the metronome clock. The logic is adaptive to the number of switch closures which is not a prespecified or selected number.

BRIEF DESCRIPTION OF THE DRAWINGS

For a better understanding of the invention reference should be made to the accompanying drawings.

DETAILED DESCRIPTION OF THE INVENTION

The present invention is directed to a metronome clock incorporated as the timing signal source for an automatic rhythm generator used with a musical instrument.

Figure 1:
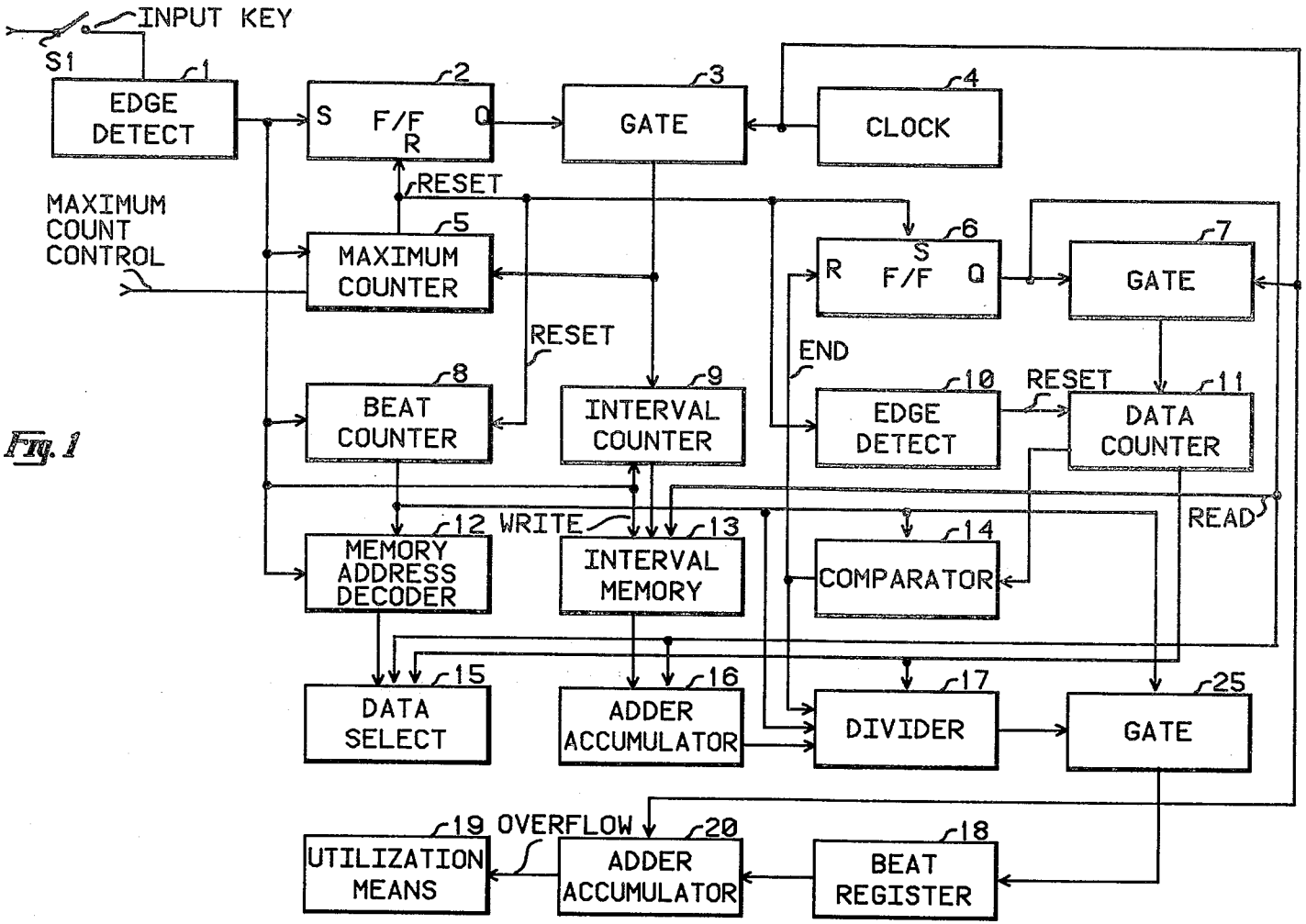
FIG. 1 is a block diagram of a metronome clock system for a rhythm generator.

FIG. 1 illustrates a system embodying the present invention.

The adaptive metronome clock system shown in FIG. 1 employs input data generated by a sequence of closures, or actuations, of the input key S1. A convenient implementation of the input key is a tap switch which is actuated by finger pressure. An alternate arrangement is to employ a foot operated switch which implements the foot tapping beat mechanism frequently used by musicians. The input key S1 is implemented to be in a nominal unactuated, or switch open, state at the end of each actuation.

Each time that the input key S1 is actuated, edge detect 1 generates a pulse-like input signal by performing an edge detect on the voltage state at the output terminal of input key S1.

The input signal generated by the action of edge detect 1 is used to set the flip-flop 2. When flip-flop 2 is set, its output has a logic state Q="1".

The clock 4 provides timing pulses which are used to time the operation of the system elements shown in FIG. 1. The precise frequency of the timing pulses is not critical to the system operation and a good value is to have a frequency whose period is not greater than about one-thirty second of the fastest metronome beat to be generated.

In response to a flip-flop 2 output state of Q="1", gate 3 will transfer timing pulses from the clock 4 to be used to increment both the maximum counter 5 and the interval counter 9.

The maximum counter 5 is reset to its initial count state in response to each input signal generated by the edge detect 1. The count state of the maximum counter is then incremented by the timing pulses from clock 4 transferred via gate 3. If the maximum counter 5 reaches a preselected maximum count, a RESET signal is generated which is used to reset the flip-flop 2 placing its output in the logic state Q="0". In response to the state Q="0", the gate 3 inhibits the transfer of timing pulses from clock 4 to the maximum counter 5 and the interval counter 9. The net result is that the RESET signal generated by the maximum counter 5 will be created at a time following an input signal from the edge detect 1 equal to the preselected maximum count multiplied by the period of the timing signals produced by clock 4.

The maximum counter 5 is implemented as a counter whose maximum count can be varied in response to a maximum count control signal. The maximum count control signal can be furnished by means of any convenient signal generating arrangement such as multi-position switch which selects control signals suitable for setting the maximum count of the maximum counter 5. The maximum counter will count modulo a number which corresponds to the maximum count control signal.

The interval counter 9 is reset to its initial count state in response to a signal from the output of edge detect 1. The interval counter 9 is incremented by the timing signals from clock 4 transferred via gate 3. The function of the interval counter is to provide a count state which is a measure of the time interval between successive actuations of the input key S1 as measured in a number of timing signals from clock 4.

The beat counter 8 is incremented by the output signals produced by the edge detect 1. The beat counter 8 is reset by the RESET signal produced by the maximum counter 5 when it reaches its maximum count state. In this fashion the count state of the beat counter 8 is equal to the number of times that the input key S1 has been actuated such that no successive spacing between actuations is greater than the time required for the maximum counter 5 to reach its maximum count state.

Each time that a signal appears at the output of the edge detect 1, memory address decoder 12 formats the current count state of the beat counter 8 in a format suitable for addressing words in the interval memory 13.

Data select 15 is used to select memory address signals from either the memory address decoder 12 or the data counter 11. The memory address signals are selected from the memory address decoder 12 if the output logic state from the flip-flop 6 is Q="0". Q="0" exists if flip-flop has not been set. This state occurs during the data entry mode in which the input key S1 is acutated in a sequence of time intervals which are less than the time required for the maximum counter 5 to reach its maximum count. The time interval required for the maximum counter 5 to reach its maximum count state when incremented by the timing signals from clock 4 is called the threshold time.

During the data entry mode, each successive actuation of the input key S1 will cause the edge detect 1 to furnish a WRITE signal to the interval memory 13. The interval memory 13 can be implemented as a RAM, or an addressable memory (Random Access Memory). In response to the WRITE signal, the current count state of the interval counter 9 is stored in the interval memory 13 at an address corresponding to the state of the beat counter 8 as formatted by the memory address decoder 12 and transferred by the data select 15.

When the data entry mode is terminated by ceasing the actuation of the input key S1, the maximum counter 5 will be incremented to its maximum count state and it will generate its RESET signal. The RESET signal from the maximum counter 5 is converted to a pluse signal by means of the edge detect 10. The output pulse signal created by the edge detect 10 is used to reset the data counter 11 to an initial count state.

The RESET signal generated by the maximum counter 5 is also used to set the flip-flop 6. When flip-flop 6 is set, its output is the logic state Q="1". In response to this logic state Q="1", the gate 7 transfers timing signals from the clock 4 which are used to increment the states of the data counter 11.

Setting the flip-flop 6 initiates a data computation mode during which the frequency for the metronome clock is determined. When the output state of the flip-flop 6 is Q="1", the data select 15 will select the contents of the data counter 11 to read out stored interval time values contained in the interval memory 13. The interval memory 13 is placed in a data read out state of operation in response to the logic state Q="1" from the flip-flop 6.

As stored interval numbers are read out of the interval memory 13 in response to the incremented count states of the data counter 11, they are summed and the summed value accumulated by means of the adder-accumulator 16. The accumulator contained in the adder-accumulator 16 is cleared to a zero initial value when flip-flop 6 is set at the start of a data computation mode.

The current count state of the data counter 11 during a data computation mode is compared with the count state of the beat counter 8 by means of the comparator 14. The count state of the beat counter 8 does not change during a data computation mode. When the data counter 11 has been incremented to the same count state as that of the beat counter 8, comparator 14 generates an END signal. The flip-flop 6 is reset in response to the END signal and thereby terminates the process of reading stored data out of the interval counter 9.

In response to the END signal, divider 17 divides the sum contained in the adder-accumulator 17 by a number which is equal to one less than the count state of the data counter 11. This number is equal to the number of time intervals that have been stored in the interval counter 9 during the data input mode. The output from the divider 17 is a frequency number corresponding to the average of the sequence of timing intervals of actuations of the input key S1. This number is measured as a number of periods of the timing signals provided by clock 4. The generated frequency number is transferred via gate 25 and stored in the beat register 18.

The count state of the beat counter 8 is provided as an input control signal to the divider. If this count state is zero (its initial binary count state), then the divider 17 is inhibited from performing its division function. In this manner the problem of dividing by a zero divisor is circumvented for the case in which the input key S1 has only been actuated a single time during the threshold time interval.

The frequency number stored in the beat register 18 is successively added to the contents of an accumulator in the adder-accumulalator 20 in response of the timing signals provided by clock 4. Each time the accumulator overflows and returns to a low count state, an overflow signal is created. The sequence of overflow signals constitutes the output timing signals furnished to the utilization means 19. This combination constitutes a subsystem that is called a non-integer frequency divider. A frequently employed alternative implementation of a non-integer frequency divider is to generate an output timing signal each time that some preselected bit position in the accummulator changes its binary logic state.

The utilization means 19 can comprise a rhythm generator in which the overflow signals from the adder-accumulator 20 are used as the metronome clock. The utilization means can also comprise a variety of musical effects systems whose speed is controlled by the musician. These include, but are not limited to, portamento systems, note repeats, attack/release times, vibrato speeds, and automatic arpeggios.

It is noted that the use of a threshold time controlled by the maximum counter 5 causes the system to ignore an accidental data input produced by a single closure of the input key switch S1. At lease two successive switch actuations in a time interval less than the threshold time are required before any change will be made in the output timing pulses from the adder-accumulator 20. Suppose that only a single actuation of the input key S1 occurs. In this case when the maximum counter 5 is incremented to its full count, the count state of the beat counter 8 is one. (It is assumed that the initial state of the counter is the decimal value "one" which corresponds to the binary count state of "zero".) For the first time instant of the data computation mode, the data counter 11 is in its initial count state which is equal to the count state of the beat counter 8. Thus the comparator 14 generates an END signal at this initial time. If the beat counter 8 is in its initial count state during the data computation mode, then the output from the divider 7 is inhibited by gate 25 from being transferred and stored in the beat register 18. Therefore a single switch actuation of S1 will not change the output signals from the adder-accumulator 20.

While the frequency rate of clock 4 is not critical in most musical systems, its frequency can be advantageously set by the following criteria. Suppose the maximum number of beats is selected as 360 beats per minute and a resolution of 1/32 notes is desired then the clock frequency should be set at:

$$f=(360/60)\times 32=192 \text{ hz.}$$

Figure 2:
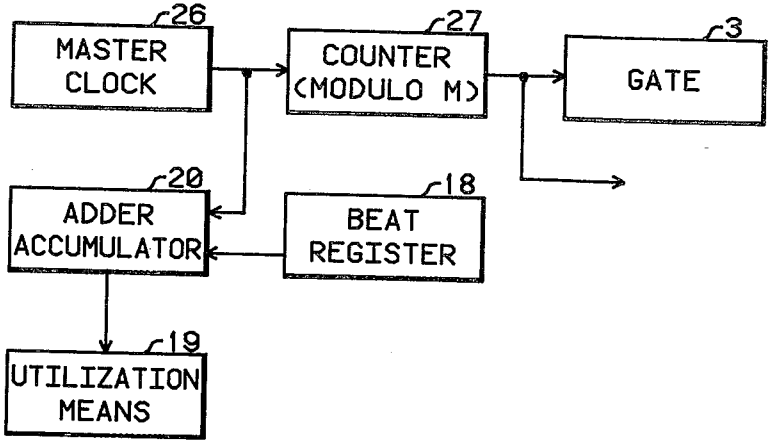
FIG. 2 is a block diagram of the clock system.

In the system shown in FIG. 1, the overflow signals from the adder-accumulator 20 will occur at the average beat rate with a time resolution, for example, of 1/32 of a beat. For many applications such as a rhythm generator metronome clock, it is desirable to have about 16 clock pulses per beat to permit a rhythmic pattern comprising 1/16 note variations. FIG. 2 illustrates a clock arrangement that will provide a number M of clock signals for each metronome beat.

Timing signals are produced by the master clock 4. If the output signals from the adder-accumulator 20 provided to the utilization means 19 are desired for M=16 clock signal for each metronome beat (corresponding to 1/16 note timing), then the master clock 4 should advantageously be an adjustable frequency clock capable of operating at a frequency of:

$$f = (360/60) \times 32 \times M$$
$$= (360/60) \times 32 \times 16 = 3072 \text{ hz.}$$

The timing signals produced by the master clock 26 are frequency divided by a division of M by means of the counter 27. The reset pulses generated each time that the counter 27 returns to its initial state, because it counts modulo M, are used to replace the output of clock 4 which is shown in FIG. 1.

I claim:

1. Apparatus for generating an output sequence of signals having a time spacing corresponding to the average time spacing of a number of actuations of a control switch comprising;

detection means whereby a detect signal is generated each time said control switch is actuated, interval generating means responsive to said detect signal whereby an interval number is generated corresponding to the time interval between successive generations of said detect signal, an interval memory means for storing said interval number in response to said detect signal, interval averaging means whereby a frequency number is generated corresponding to the average value of stored interval numbers read out of said interval memory means, frequency generating means whereby said output sequence of signals is generated having a time spacing corresponding to said frequency number, and utilization means whereby said output sequence of signals is used as a frequency control signal source.

2. Apparatus according to claim 1 wherein said interval averaging means comprises;

threshold generating circuitry whereby a threshold signal is generated when said time interval exceeds a preselected value, summing means responsive to said threshold signal whereby stored interval numbers are summed as they are read out of said interval memory means to form a summed value, and averaging means whereby said summed value is divided by the number of said actuations diminished by one to generate said frequency number.

3. Apparatus for generating a sequence of equally spaced timing signals having a time separation corresponding to successive actuations of a control switch comprising;

detection means wherein a detect signal is generated when said control switch is actuated, a clock means for generating timing signals, an interval counter means having a count state incremented by said timing signals, a first count reset circuitry responsive to said detect signal whereby said interval counter means is reset to an initial count state, a memory means for storing data to be thereafter read out, a beat counter means incremented by said detect signal, memory writing means responsive to said detect signal whereby the count state of said interval counter means is stored in said memory means at a memory location corresponding to the count state of said beat counter means, interval averaging means whereby a frequency number is generated from data read out of said memory means, frequency generating means responsive to said timing signals whereby a sequence of output timing signals is generated at a frequency corresponding to said frequency number, and utilization means whereby said output timing signals are used as a variable frequency control signal sequence.

4. Apparatus according to claim 3 further comprising a threshold gating means interposed between said clock means and said interval counter means whereby said timing signals are not provided to said interval counter means if successive actuations of said control switch corresponds to a time interval which exceeds a preselected number of said timing signals.

5. Apparatus according to claim 4 whereby said threshold gating means further comprises;

a first gate interposed between said clock means and said interval counter means whereby said timing signals are transferred to said interval counter means in response to a count signal, a threshold counter means having a threshold count state incremented by timing signals transferred to said interval counter means by said first gate, threshold circuitry responsive to said threshold count state of said threshold counter means wherein a threshold signal is generated if said count state is greater in value than a preselected maximum count value, a gating signal generating means responsive to said detect signal and said threshold signal wherein said count signal is generated if said detect signal is generated and said threshold signal is not generated, and whereby said count signal is not generated if said threshold signal is generated; and a second count reset circuitry responsive to said detect signal whereby said threshold counter means is reset to an initial count state.

6. Apparatus according to claim 5 wherein said threshold counter means comprises a counter which counts said timing signals modulo a number which corresponds to said preselected maximum count value.

7. Apparatus according to claim 5 wherein said beat counter means comprises a third count reset circuitry responsive to said threshold signal whereby said beat counter means is reset to an initial count

8. Apparatus according to claim 7 wherein said interval averaging means comprises;

a data counter means having a count state incremented by said timing signals, a data gating means interposed between said clock means and said data counter means whereby said timing signals are provided to said data counter means if said threshold signal is generated, memory addressing means responsive to count state of said data counter means whereby count states of said interval counter means stored in said memory means are addressed out if said threshold signal is generated, a first adder-accumulator means whereby said stored count states of said interval counter means addressed out of said memory means are summed to form a summed count value, termination means whereby an end signal is generated when said data counter means has been incremented to a count state equal to the count state of said beat counter means, inhibit circuitry whereby said threshold signal is not provided to said data gating means and said memory addressing means if said end signal is generated, and computation means responsive to said summed count value for generating said frequency number when said end signal is generated.

9. Apparatus according to claim 8 wherein said interval averaging means further comprises;

a fourth count reset circuitry responsive to said threshold signal whereby said data counter means is reset to an initial count state.

10. Apparatus according to claim 9 wherein said computation means comprises;

a frequency memory means for storing data to be thereafter read out, division means whereby said frequency number is generated by dividing said summed count value by a number equal in value to the count state of said beat counter diminished by one count, and a frequency addressing means whereby said frequency number is stored in said frequency memory means.

11. Apparatus according to claim 10 wherein said frequency generating means comprises;

a second adder-accumulator means, operative at each timing signal from said clock means, whereby said frequency number is addressed out from said frequency memory means and added to the sum previously contained in the second adder-accumulator means and wherein the second adder-accumulator means generates each of said output timing signals whenever a change occurs in the state of a preselected bit position for said sum.

12. Apparatus according to claim 10 wherein said division means comprises a zero inhibit means whereby said frequency number is not generated if said beat counter means is in its initial count state.

13. Apparatus according to claim 3 wherein said utilization means comprises an automatic rhythm generator.

* * * * *